United States Patent [19]

Yoshida et al.

[11] Patent Number: 4,694,888

[45] Date of Patent: Sep. 22, 1987

[54] ELECTROMAGNETIC LEVITATION CASTING

[75] Inventors: Masahiro Yoshida, Aichi; Susumu Inumaru, Nagoya, both of Japan

[73] Assignee: Sumitomo Light Metal Industries, Ltd., Japan

[21] Appl. No.: 824,272

[22] Filed: Jan. 30, 1986

[30] Foreign Application Priority Data

Feb. 13, 1985 [JP] Japan ..... 60-25495

[51] Int. Cl.[4] ..... B22D 27/02; B22D 11/10

[52] U.S. Cl. ..... 164/467; 164/490

[58] Field of Search ..... 164/467, 503, 490, 487

[56] References Cited

U.S. PATENT DOCUMENTS 4,469,165 9/1984 Ungarean et al. ..... 164/467

FOREIGN PATENT DOCUMENTS 0043987 1/1982 European Pat. Off. .
67433 12/1982 European Pat. Off. ..... 164/467
0068402 1/1983 European Pat. Off. .
2756112 6/1978 Fed. Rep. of Germany .
2830284 1/1979 Fed. Rep. of Germany .

*Primary Examiner*—Kuang Y. Lin
*Attorney, Agent, or Firm*—Parkhurst & Oliff

[57] ABSTRACT

An electromagnetic horizontal casting process for continuously casting a flat ingot in a horizontal direction, including the steps of: transferring a mass of molten metal through a nozzle having an opening which has a rectangular cross sectional shape substantially corresponding to a rectangular transverse cross sectional shape of the flat to be formed, the cross sectional shape of the opening having long sides extending in the horizontal direction; causing the mass of molten metal to continuously emerge in the horizontal direction from an exit end of said nozzle; levitating the mass of molten metal which has emerged from the nozzle, in the horizontal direction with electromagnetic forces created by an upper and a lower electromagnetic coil which are disposed in a mutually vertically spaced-apart relation adjacent to the exit end of the nozzle; solidifying the levitated mass of molten metal into the flat ingot, by direct contact of the molten mass with a cooling fluid; and withdrawing the flat ingot continuouslly in the horizontal direction.

3 Claims, 2 Drawing Figures

ELECTROMAGNETIC LEVITATION CASTING

BACKGROUND OF THE INVENTION

1. Field of the Art

The present invention relates in general to an electromagnetic levitation casting, and more particularly to a horizontal casting process of continuously casting a flat ingot, in particular, a thin strip, by utilizing electromagnetism to levitate a mass of molten metal introduced in a horizontal direction, in combination with a direct chilling operation to solidify the molten metal.

2. Related Art Statement

In recent years, a continuing casting process, so-called "horizontal continuous casting", wherein a tubular casting mold is adapted for horizontal casting of an ingot, has been extensively practiced in the industry, because of its relatively high productivity, taking the place of conventional semi-continuous vertical casting processes. This horizontal continuous casting process has been drawing increased attention in the industry. A typical example of a horizontal continuous casting system is disclosed in a Japanese Patent Application which was laid open in 1982 under Publication No. 57-139448. Described more specifically, the disclosed horizontal continuous casting system employs a tundish located on one side of a tubular horizontal casting mold. The tundish holds a mass of molten metal such as aluminum or its alloy. The molten metal accommodated in the tundish is supplied to the casting mold through an opening formed in a baffle plate. The casting mold is equipped with a water jacket surrounding the mold walls, so that cooling water circulating in the water jacket cools the mold walls, whereby the mass of the melt introduced in the casting mold is cooled via the mold walls and solidified into a solid ingot. The formed solid ingot is withdrawn continuously in the horizontal direction on a suitable table (roller), and by means of pinch rolls or other conveying equipment. To assure perfect solidification of the cast ingot emerging from the mold, the mold has a water channel which communicates with the water jacket and terminates in a nozzle, so that the cooling water from the nozzle impinges upon the surface of the ingot at the exit end of the mold from which the ingot emerges. Thus, the ingot is further cooled with the coolant delivered through the nozzle.

As an alternative to the horizontal continuous casting method using the stationary casting mold discussed above, roll-casting methods using cooling rolls are also available for continuously casting a flat ingot, particularly a thin strip. For example, Hunter casting and 3C-casting (Continuous Casting between Cylinders) are well known as roll-casting methods. In the roll-casting system, two cooling rolls are disposed in a vertically spaced-apart relation with each other, and the molten metal fed from a tundish is directed through a gap between the cooling rolls so that the melt mass contacting the cooling rolls is solidified into a solid strip. Thus, the solid strip is continuously cast.

PROBLEM SOLVED BY THE INVENTION

However, the above-described horizontal continuous casting processes practiced in the prior art for producing a flat ingot, suffer from various potential problems which arise from direct contact of a melt mass with the cooling surfaces of the mold walls or cooling rolls for solidifation of the melt. More particularly, the stationary water-cooled mold previously discussed is subject to a difference in temperature between upper and lower surfaces of the mold, due to influence of gravity on thermal conduction within the mold. This tends to cause friction (friction between the mold surface and the ingot), or hot tears, and sticking or welding, which result in deterioration of the cast surface quality of the ingot.

In the roll-casting method for continuous casting of a flat ingot, the pressure between the cooling rolls and the melt mass contributes to maintaining a good contact of the melt mass with the surfaces of the cooling rolls, permitting rapid cooling of the molten metal. However, the pressure exerted on the melt mass by the cooling rolls may lead to a problem of a high degree of segregation within the flat ingot due to removal of solutes, if the content of an alloying element of an alloy to be cast is considerably large. Further, surface flaws and imperfections of the flat ingot are inevitable, because of the cooling and solidification of the melt through direct contact with the roll surfaces Moreover, the contact of the solidifying ingot with the cooling rolls leads to surface cracking of the ingot. Therefore, the alloy has limitations in maximum content of alloying element(s) and in casting speed. For instance, 4% is the maximum content of magnesium of an aluminum-magnesium alloy.

SUMMARY OF THE INVENTION

It is accordingly an object of the present invention to solve or alleviate the foregoing inconveniences experienced in the prior art. According to the present invention, there is provided an electromagnetic horizontal casting process for continuously casting a flat ingot in a horizontal direction, comprising the steps of: transferring a mass of molten metal through a nozzle having an opening which has a rectangular cross sectional shape substantially corresponding to a rectangular transverse cross sectional shape of the flat ingot, the cross sectional shape of the opening having long sides extending in the horizontal direction; causing the mass of molten metal to continuously emerge in the horizontal direction from an exit end of said nozzle; subjecting the mass of molten metal which has emerged from the nozzle, to electromagnetic forces created by an upper and a lower electromagnetic coil disposed in a mutually vertically spaced-apart relationship adjacent to the exit end of the nozzle, and thereby levitating the mass of molten metal in the horizontal direction between the upper and lower electromagnetic coils; solidifying the levitated mass of molten metal into a flat ingot by direct contact of the molten mass with a cooling fluid; and withdrawing the flat ingot continuously in the horizontal direction.

DETAILED DESCRIPTION OF THE INVENTION

In the casting process of the invention, as described above, a flow of the molten metal which has emerged from the exit end of the nozzle is levitated between the electromagnetic coils with electromagnetic forces produced thereby, i.e., supported free of contact of the mass of molten metal with a casting mold. In this levitated condition, the melt mass is directly chilled and solidified in the complete absence of contact of the molten metal with a chilled mold. That is, the mass of molten metal which has emerged horizontally from the nozzle and which is to be solidified into a solid strip, is levitated over a suitable distance by and between the upper and lower electromagnetic coils which are spaced apart from each other in the vertical direction, so as to hold the flow of the molten metal in a levitating manner. This electromagnetic horizontal continuous casting is contrary to conventional electromagnetic vertical semi-continuous casting processes in which a column of molten metal is contained by an electromagnetic coil surrounding the molten column, without the molten metal contacting a solid enclosure.

More specifically, the lower electromagnetic coil disposed adjacent to the exit end of the nozzle is adapted to levitate the flow of the molten metal fed from the nozzle, by utilizing electromagnetic repulsive forces which are caused by an electromagnetic field applied to the lower coil and eddy currents induced in the mass of molten metal, according to the principle of conventional electromagnetic casting. However, the repulsive forces are applied in the vertical direction. In the meantime, the upper electromagnetic coil generates similar electromagnetic forces, which act on the upper surface of the flow of the molten metal between the upper and lower coils, so as to suppress the upper surface of the flow, whereby the flow of the molten metal is levitated and shaped in the intended rectangular form in transverse cross section of the cast strip to be produced.

It will be understood from the foregoing and the following description that the instant horizontal electromagnetic casting process makes use of electromagnetism to levitate a mass of molten metal, in combination with a direct chilling operation to solidify the mass of molten metal, in order to obtain a flat ingot. The electromagnetic levitation of the molten mass, and the complete absence of contact of the molten mass during the direct chilling for solidification, effectively contribute to improvements in surface quality of the cast strip. Further, the instant process permits a rapid direct chilling (by cooling water) of the molten metal and the solidifying ingot, without a contact of the molten metal or sollidifying ingot with water-jacketed mold walls or cooling rolls. Thus, the ingot cast in the instant process has a fine-grained structure. Further, the absence of the cooling rolls and the consequent absence of pressure on the solidifying ingot results in elimination of internal segragation of alloying constituents of the ingot. Moreover, the electromagnetic levitation according to the invention assures the casting of flat ingots of alloys of any desired composition, without minimum surface flaws or defects. Furthermore, the instant process may be practiced on a casting system which is more compact than a conventional casting system in which a mass of molten metal is directly rolled into a cast strip.

BRIEF DESCRIPTION OF THE DRAWINGS

The above and optional objects, features and advantages of the present invention will become more apparent from reading the following detailed description of a preferred embodiment of the invention, when considered in connection with the accompanying drawing, in which.

DETAILED DESCRIPTION OF THE PREFERRED EMBODIMENT

Figure 1:
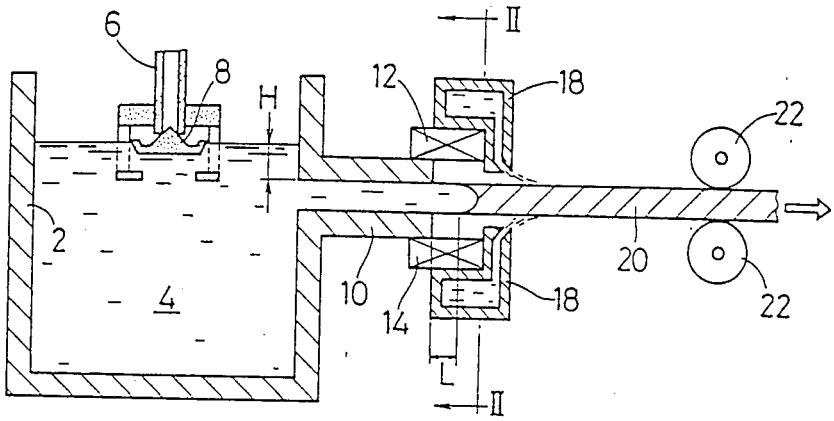
FIG. 1 is an elevational view in cross section of one example of a casting system suitable for practicing a process of the present invention.
Figure 2:
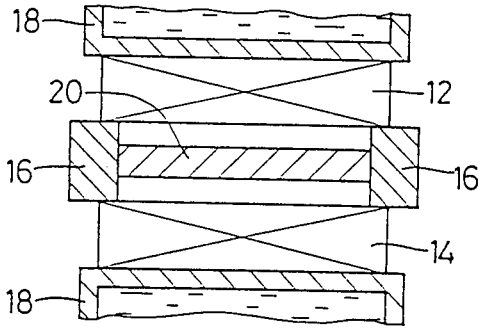
FIG. 2 is a fragmentary cross sectional view taken along line II—II of FIG. 1.

Referring to FIGS. 1 and 2, there is shown an exemplary casting system suitable for practicing one embodiment of a casting process of the invention, wherein reference numeral 2 designates a tundish which is cnstructed to contain a molten pool 4 of desired metal such as aluminum or its alloy, or copper or its alloy. The molten pool 4 is introduced into the tundish 2 through a piping 6, and the level of the meniscus of the molten pool 4 is controlled by a float 8 or other suitable level-adjusting means, so that the meniscus of the pool 4 is maintained at a predetermined level. The tundish 2 is formed with a nozzle 10 which extends in the horizontal direction to transfer or feed therethrough a flow of the molten metal from the molten pool 4, in order to produce a flat ingot 20. Described in more detail, the nozzle 10 has an opening whose shape in the transverse cross section of the nozzle 10 is substantially identical with the transverse cross sectional shape of the flat ingot 20 to be produced. For example, the opening of the nozzle 10 assumes the shape of a rectangle which has the long sides extending in the horizontal direction (direction perpendicular to the surface of the drawing sheet of FIG. 1). In this arrangement, a continuous flow of the melt emerges horizontally from the exit end of the nozzle 10, taking the rectangular cross sectional shape corresponding to the shape of the opening. The level of the surface (meniscus) of the molten pool 4 in the tundish 2 is regulated by the float 8 so that a predetermined overhead distance H is maintained between the meniscus and the lower surface of the upper wall of the nozzle 10.

Adjacent to the exit end of the nozzle 10, there are provided an upper and a lower electromagnetic inductor coil 12, 14 which are disposed parallel to the long sides of the rectangle of the opening in the nozzle 10, such that the upper and lower inductor coils 12, 14 are opposed to each other. The upper and lower inductor coils 12, 14 are spaced apart from each other in the vertical direction, by a pair of dam blocks 16, 16 which are disposed at opposite ends of the parallel upper and lower inductor coils 12, 14, as shown in FIG. 2, such that the dam blocks 16, 16 extend parallel to the short sides of the rectangle of the nozzle opening. The flow of the molten metal which has emerged from the exit end of the nozzle 10 is passed through the upper and lower inductor coils 12, 14, and is solidified by cooling a water spout from an upper and a lower water jacket 18, 18 which are located adjacent to and downstream from the respective upper and lower inductor coils 12, 14, as indicated in FIG. 1. Thus, the solid cast strip 20 (flat rectangular ingot) is formed in a continuous manner. Downstream of the water jackets 18, 18, there are provided a pair of vertically spaced-apart pinch rolls 22 for withdrawing the continuously solidified cast strip or flat ingot 20 in the horizontal direction away from the water jackets 18, 18.

In the horizontal casting system constructed as described hitherto, the flow of the molten metal (4) which emerges from the nozzle 10 and assumes a rectangular cross sectional shape, is levitated or supported with electromagnetic forces created by the lower electromagnetic inductor coil 14, such that the mass of the molten metal (4) passing through the inductor coils 12, 14 is held intact with the lower inductor coil 14. More particularly, the melt mass is levitated above the lower inductor coil 14, over a suitable distance L between the exit end of the nozzle 10 and the solidification front of the melt mass. This distance L should be relatively small, preferably held within a range of 5–20 mm. With an increase in the distance L, the stability of the shape of the cast srip 20 is reduced.

The upper electromagnetic inductor coil 12 serves to suppress pulsation of the molten metal which occurs, due to its electromagnetic motion, at the upper surface of the melt mass which is flowing between the upper and lower coils 12, 14 which the melt mass is levitated by the lower coil 14. The upper coil 12 creates electromagnetic forces which not only counteract a potential due to the overhead distance H, but also act on the upper surface of the melt flow for suppressing the pulsation of the melt flow. In this connection, it is noted that the overhead distance H should be determined for stable transfer of the molten metal through the nozzle 10. However, the principle of the present invention may be implemented even if the overhead distance H is zero. In this case, the upper surface of the cast strip may be unstable in quality.

As indicated above, the mass of the molten metal (4) moves between the upper and lower inductor coils 12, 14 (and between the dam blocks 16, 16), while being levitated without a contact of the upper and lower surfaces of the melt mass with chilled mold walls or cooling rolls. The thus supported mass of the melt is directly chilled by the cooling water delivered from the water jackets 18, 18, and consequently solidified into the solid cast strip 20. In this manner, the cast strip 20 is continuously formed, in absence of the contact between the solidifying molten metal and mold walls or cooling rolls. The formed cast strip 20 is withdrawn by the pinch rolls 22, 22. As is apparent from the foregoing description, the opposite short sides of the cast strip 20 are defined by the dam blocks 16, 16 which are positioned so as to extend from the exit end of the nozzle 10, parallel to the short sides of the rectangular opening of the nozzle 10. In other words, the dam blocks 16, 16 control the transverse width of themelt flow, i.e., the dimension of the long sides of the rectangular cross section of the cast strip 20.

While the present invention has been described in detail in its preferred embodiment, it is to be understood that the invention is not confined to the precise disclosure contained herein, but may be embodied with various changes, modifications and improvements which may occur to those skilled in the art, without departing from the spirit and scope of the invention defined in the appended claims.

What is claimed is:

1. An electromagnetic levitation casting process for continuously casting a flat ingot in a horizontal direction, comprising the steps of:

transferring a mass of molten metal having a composition selected from the group consisting of aluminum and aluminum alloys through a nozzle having an opening which has a rectangular cross sectional shape substantially corresponding to a transverse cross sectional shape of said flat ingot, the rectangular cross sectional shape of said opening having long sides extending in the horizontal direction.

causing said mass of molten metal to continuously emerge in said horizontal direction from an exit end of said nozzle;

subject the mass of molten metal which has emerged from said nozzle, to electromagnetic forces created by an upper and a lower electromagnetic coil disposed in a mutually vertically spaced-apart relationship adjacent to said exit end of said nozzle, and thereby levitating the mass of molten metal in the horizontal direction between said upper and lower electromagnetic coils for a horizontal distance of 5–20 mm from said exit end of said nozzle;

controlling a transverse width of said flat ingot with at least a pair of dam blocks, said dam blocks being located at said exit end of said nozzle such that said dam blocks extend horizontally away from the nozzle and parallel to short sides of the rectangular transverse cross sectional shape of the nozzle and said dam blocks maintain a vertical separation between said upper and lower electromagnetic coils;

solidifying the levitated mass of molten metal into said flat ingot, by direct contact of the molten mass with a cooling fluid, said cooling fluid being delivered by at least an upper water jacket and a lower water jacket, said upper and lower water jackets being located adjacent to and downstream from said upper and lower electromagnetic coils and walls defining said upper and lower water jackets being spaced apart from said mass of molten metal;

withdrawing the solidified flat ingot continuously in the horizontal direction.

2. An electromagnetic levitation casting process according to claim 1, wherein the mass of molten metal is transferred from a tundish which accommodates a pool of said molten metal and from which said nozzle extends in the horizontal direction toward said electromagnetic coils.

3. An electromagnetic levitation casting process according to claim 1, wherein said horizontal distance of 5–20 mm corresponds to a distance from said exit end of said nozzle to a solidification front of the molten mass.

* * * * *